United States Patent [19]

Kuiper-Moore

[11] Patent Number: 5,035,648

[45] Date of Patent: Jul. 30, 1991

[54] ELECTRICAL CONNECTOR HOUSING ASSEMBLY

[75] Inventor: David B. Kuiper-Moore, London, England

[73] Assignee: AMP Incorporated, Harrisburg, Pa.

[21] Appl. No.: 558,027

[22] Filed: Jul. 25, 1990

[30] Foreign Application Priority Data

Nov. 28, 1988 [GB] United Kingdom ..... 8827756

[51] Int. Cl.[5] ..... H01R 13/424

[52] U.S. Cl. ..... 439/595; 439/599; 439/752

[58] Field of Search ..... 439/333, 346, 370, 594, 439/595, 598, 599, 603, 752

[56] References Cited

U.S. PATENT DOCUMENTS

| | | | |
|---|---|---|---|
| 4,544,220 | 10/1985 | Aiello et al. | 439/595 |
| 4,611,880 | 9/1986 | Petersen et al. | 439/599 |
| 4,776,813 | 10/1988 | Wilson et al. | 439/595 |
| 4,784,617 | 11/1988 | Oda | 439/595 |
| 4,806,123 | 2/1989 | Konishi et al. | 439/595 |
| 4,944,688 | 7/1990 | Lundergan | 439/752 |
| 4,946,398 | 8/1990 | Takenouchi et al. | 439/599 |
| 4,973,268 | 11/1990 | Smith et al. | 439/595 |

*Primary Examiner*—Paula A. Bradley
*Attorney, Agent, or Firm*—William B. Noll

[57] ABSTRACT

The assembly comprises a first insulating housing (2) having terminal receiving through cavities (8) each having therein a resilient locking lance (16), and a second insulating housing (4) having through cavities (24). There projects from the front face (26) of the second housing (4) a row of locking lance actuating tongues (38). In a terminal loading position of the housings (2 and 4) the front face (26) of the second housing (4) is spaced from the front face (12) of the first housing (2) so that each tongue (38) projects to some extent beneath a respective locking lance (16). In this loading position, an electrical terminal (68) connected to a lead (L) is inserted through each cavity (24) of the second housing (4) into a cavity (8) of the first housing (2). The housings (2 and 4) are then moved relatively towards one another into a terminal locking position, so that each tongue (38) is advanced further beneath the corresponding lance (16) to lock the terminal in the cavity. Pawl and ratchet means are provided on the housings (2 and 4) for locating them in their loading and locking positions.

6 Claims, 6 Drawing Sheets

ELECTRICAL CONNECTOR HOUSING ASSEMBLY

This invention relates to an electrical connector housing assembly comprising means for positively locking electrical terminals in a housing of the assembly whilst allowing the terminals to be readily inserted into the housing.

There is a continuing need, especially in the automotive industry, for electrical connectors comprising so called secondary locking means, that is to say means for supplementing the latching effect of latching lances provided on the terminals themselves, for securing them in the cavities in a connector housing It has been found, that without such secondary locking means, the terminals back out from their cavities under the action of vibration, when a connector is in use in a vehicle and the leads connected to the terminals may be accidentally pulled, for example, when the vehicle is being serviced, which also tends to dislodge the terminals from their cavities.

There is also a continuing requirement, in the automotive industry, for electrical connectors, in which the terminals are sealed in their cavities against the ingress of moisture and, to this end, the cavities need to be dimensioned to accept the sealing means, for example, sealing grommets. If according to known practice, a terminal locking bar or comb is provided for insertion into the cavities, through openings in the housing, to lock the terminals in position, such openings afford paths for the ingress of moisture into the cavities.

According to the invention, an electrical connector housing assembly, comprises a first insulating housing having a plurality of terminal receiving first through cavities each opening into a front and rear face of the housing and each being provided with an internal terminal locking lance; a second insulating housing having a plurality of terminal access second through cavities each opening into a front and a rear face of the second housing; a terminal locking lance actuating member projecting from the front face of the second housing proximate to each of the second cavities; and means on the housings for latching them together in a terminal loading position with the front faces of the housings spaced from each other and each first cavity in alignment with a respective second cavity to allow an electrical terminal to be inserted into each first cavity by way of the second cavity aligned therewith, from the rear face of the second housing, the latching means permitting the housings to be moved relatively towards one another from said loading position, so as to be latched in a terminal locking position in which the actuating members penetrate the first cavities to actuate the locking lances therein positively to retain the terminals in the first cavities.

Conveniently, the second cavities, that is to say the terminal access cavities, serve to receive sealing grommets to which ferrules of the terminals are crimped, the provision of the second housing, which serves to perform the terminal locking function being therefore not uneconomical. Since no openings are provided in the housing for receiving a terminal locking bar or comb, the presence of moisture leakage paths is kept to a minimum.

The means for latching the housing together may conveniently comprise pawl and ratchet means formed integrally with the housings The pawl and ratchet means may comprise cooperating pairs of latch arms on the housings, one arm of each pair having a ratchet extending normally of the front face of the housing on which it is provided and the other latch arm of the pair having a pawl for meshing with a first tooth of the ratchet in said terminal loading position and with a second tooth of the ratchet in said terminal locking position.

Since the latch arms having the ratchets are likely to be of considerable length, they are most conveniently provided on the second housing and are protected by a hood projecting from the front face of the second housing, to receive the first housing.

Each locking lance may extend from a wall of its respective cavity, obliquely towards the front face of the first housing, each locking lance actuating member being in the form of a tongue which engages to a lesser extent between the respective locking lance and the wall from which it extends, in the loading position of the housings and to a greater extent in the terminal locking position thereof to force the locking lance against a terminal in the cavity. Thus when the housings are latched in a terminal locking position, the terminals can, under no circumstances, back out from their cavities.

The second housing may be formed integrally with a part of a lead exit conduit projecting from one end of the rear face of the second housing and the housing assembly may then further comprise a cover for the rear face of the second housing, which is latchable to the second housing to complete the exit conduit.

Thus, the terminal may be inserted through the second cavities by way of the rear face of the second housing, with the cover removed therefrom, leads connected to the terminals being accommodated in said part of the cable exit conduit, after which the cover is latched to the second housing so that the leads, which have preferably been enclosed in a cable jacket, extend through the completed exit conduit.

For a better understanding of the invention, an embodiment thereof will now be described by way of example with reference to the accompanying drawings in which.

Figure 1:
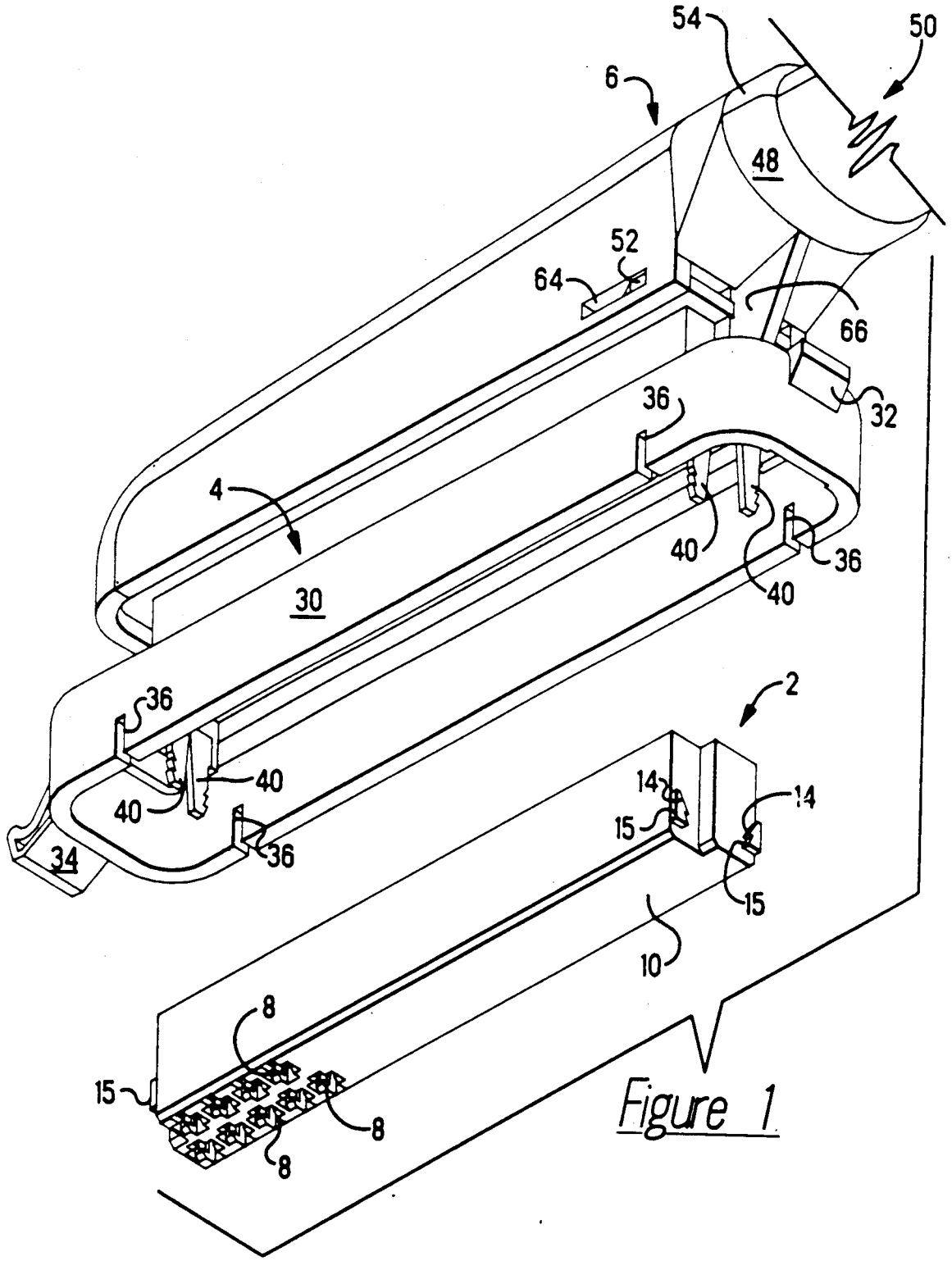
FIG. 1 is an exploded isometric view of an electrical connector housing assembly.

An electrical connector housing assembly comprises, as shown in FIG. 1, a male, first elongate insulating housing 2, a female, second elongate insulating housing 4 and an insulating cover 6 for the housing 4.

Figure 9:
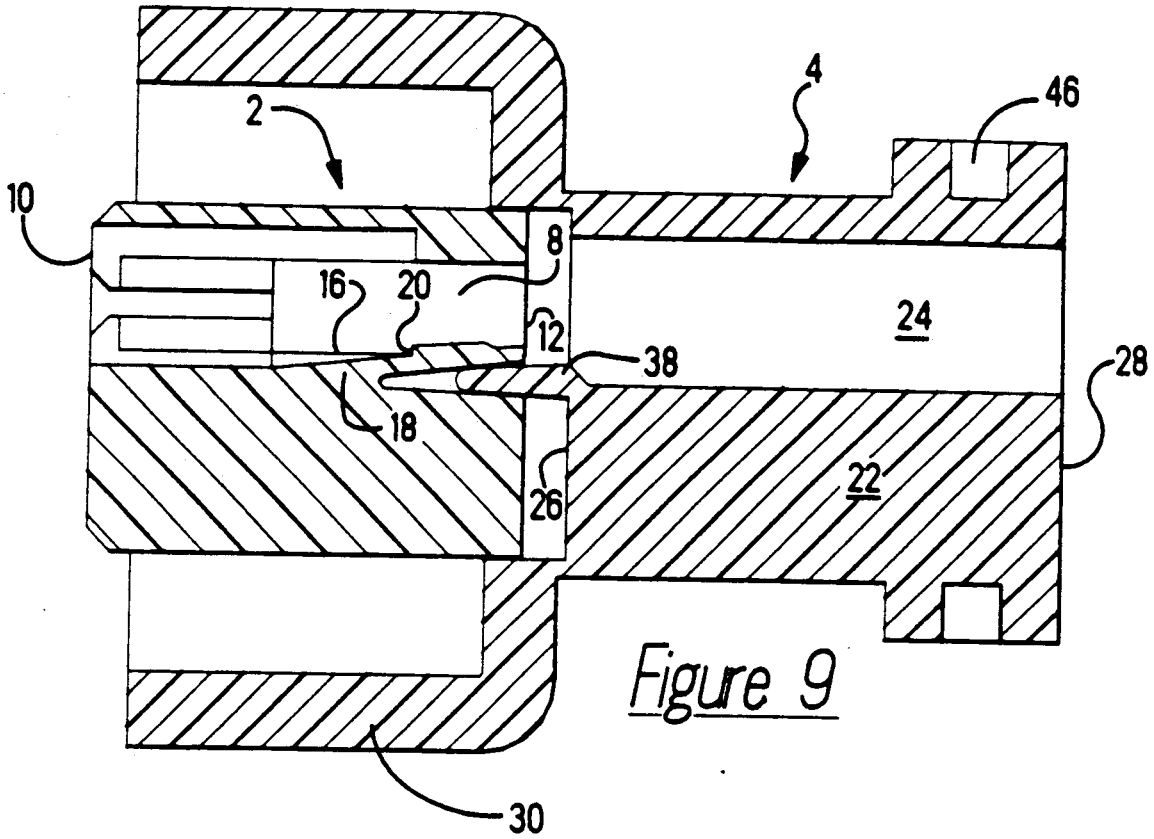
FIG. 9 is a cross-sectional view showing the male and female housings in their terminal loading position.
Figure 10:
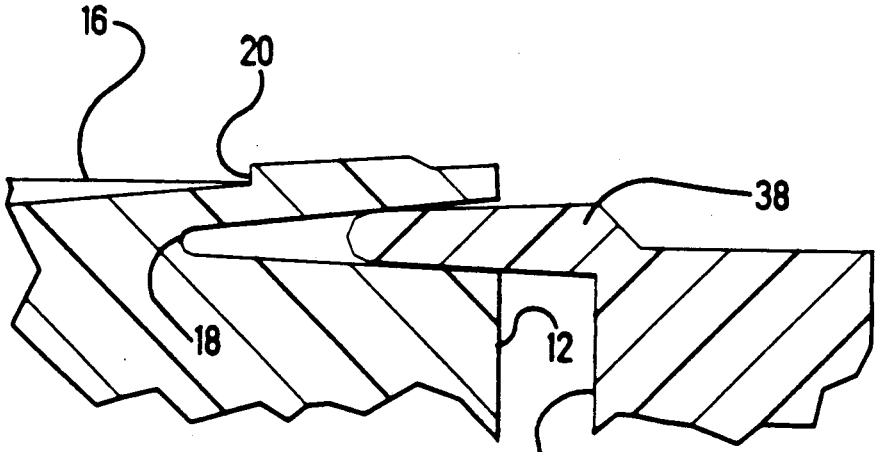
FIG. 10 is an enlarged view illustrating details of FIG. 9.
Figure 11:
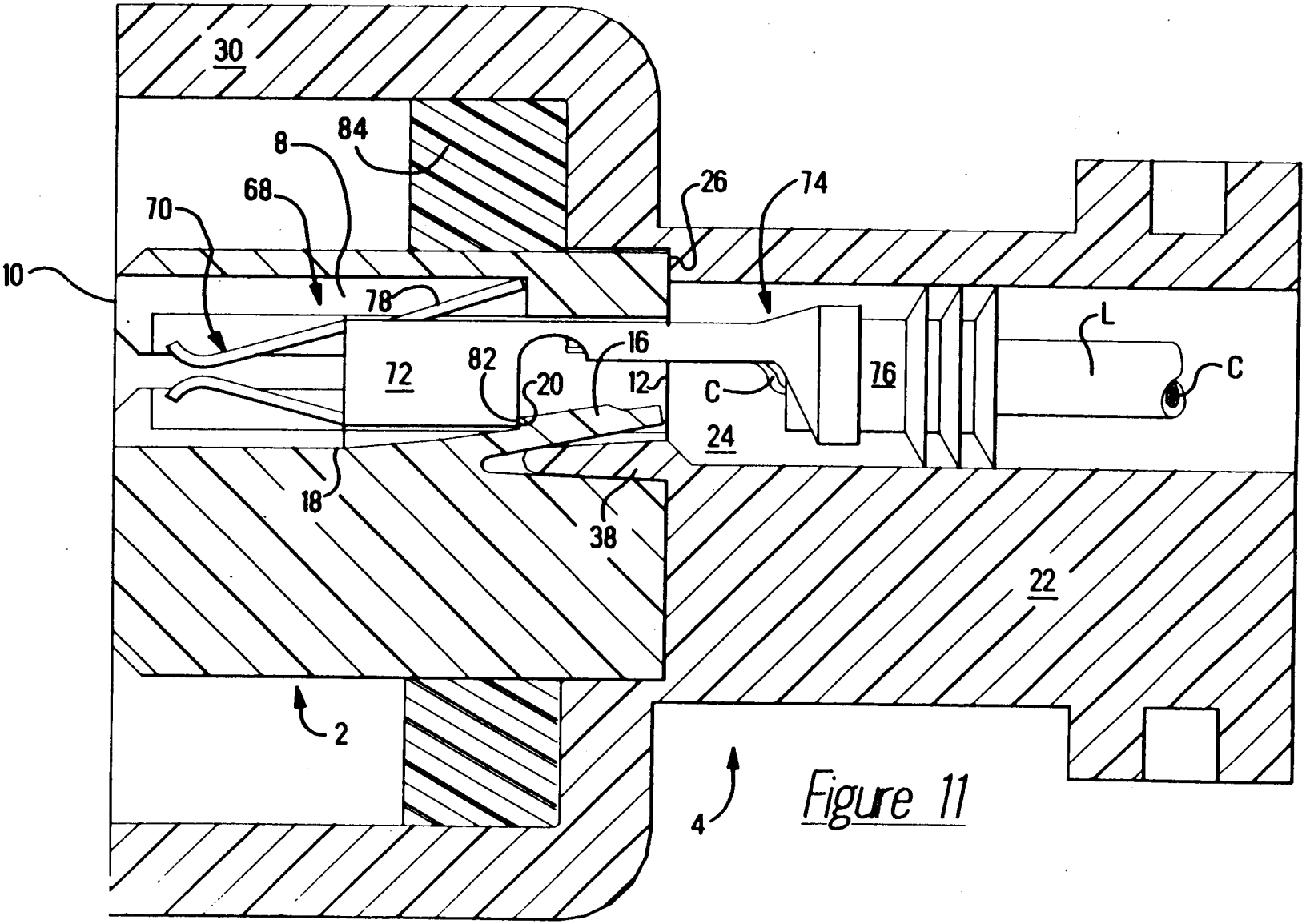
FIG. 11 is a cross-sectional view, partly in fragmentary form, showing the male and female housings in their terminal locking position.

The male housing 2 is in the form of an insulating block having two rows (only part of which is shown) of terminal receiving through cavities 8, one of which is shown in detail in FIGS. 9 and 11, each cavity 8 opening into a rear face 10, and a front face 12 of the housing 2. At each end, the housing 2 is formed with a pair of oppositely directed pawls 14 (best seen in FIG. 3) on pawl arms 15. As shown in FIGS. 3 and 9 to 11, each cavity 8 is provided with an internal, terminal locking lance 16, which, as shown in FIGS. 9 to 11 extends from a wall 18 of the respective cavity 8 obliquely towards the front wall 12 of the housing 2 and is provided with a terminal engaging shoulder 20 facing generally towards the rear wall 10. The cavities 8 of one row are staggered with respect to those of the other row and are arranged in mirror image relationship with respect thereto.

Figure 2:
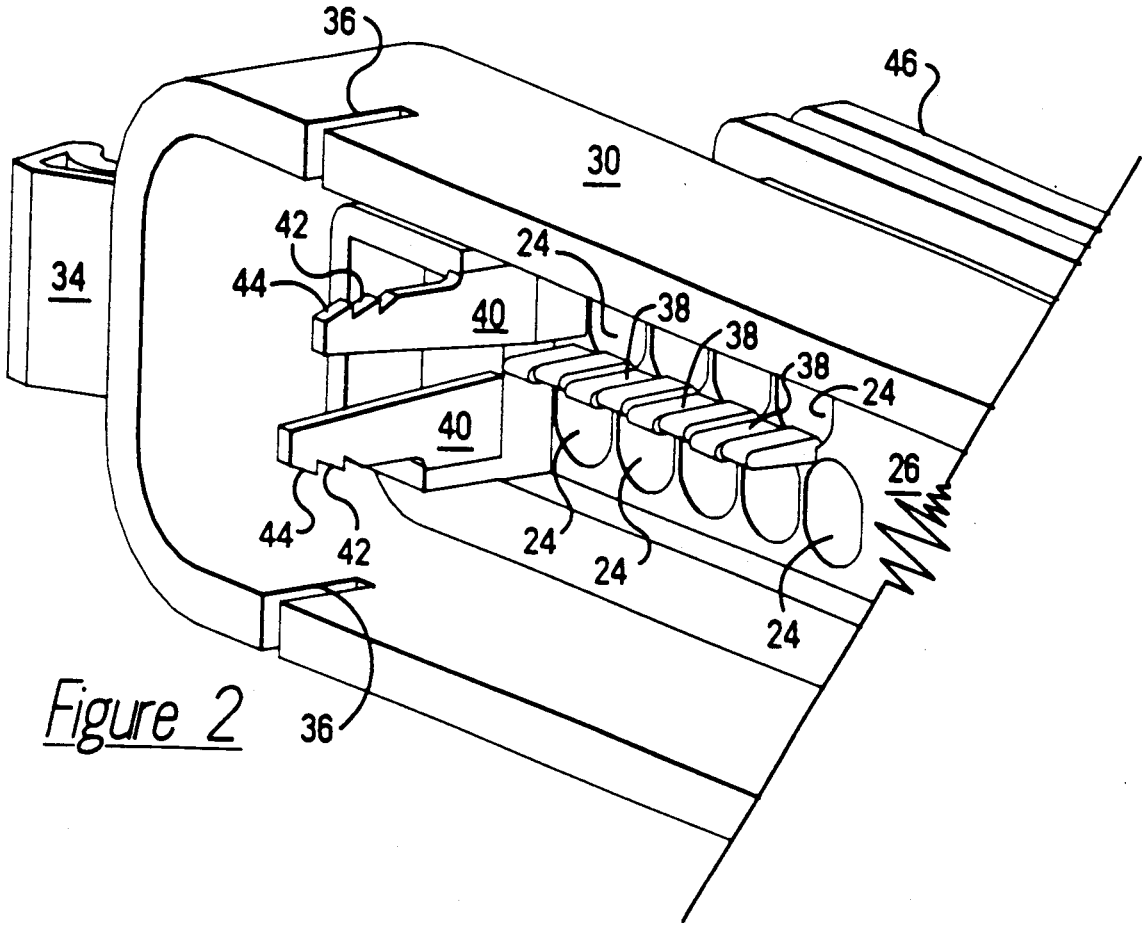
FIG. 2 is an enlarged fragmentary isometric front view of an end portion of a female insulating housing of the assembly.
Figure 3:
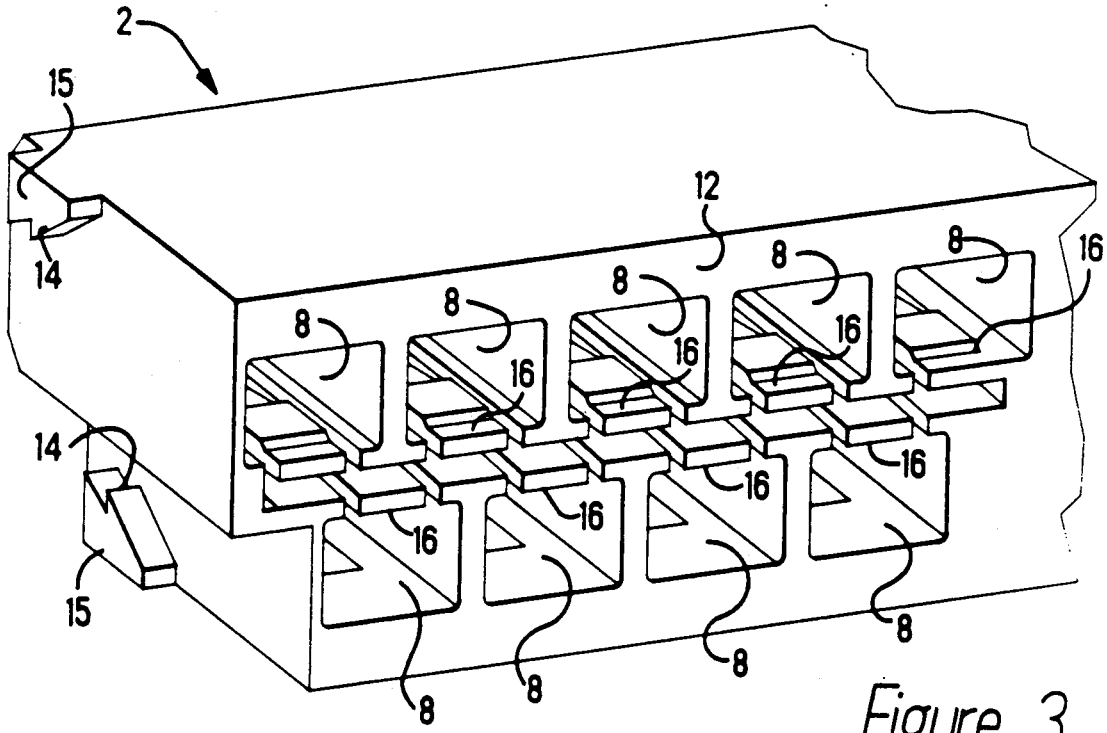
FIG. 3 is an enlarged fragmentary isometric front view of an end portion of a male insulating housing of the assembly.
Figure 5:
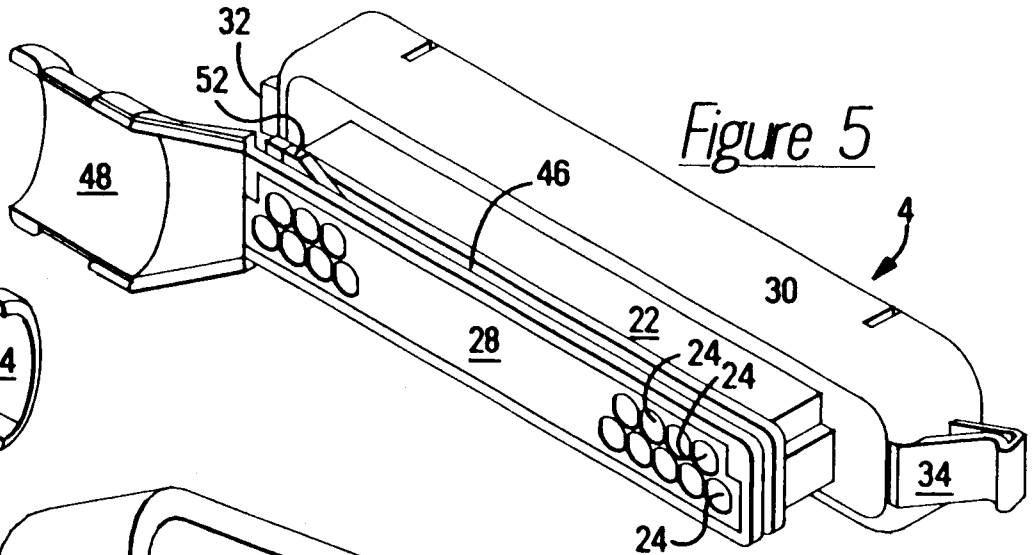
FIG. 5 is an isometric rear view of the female housing.
Figure 6:
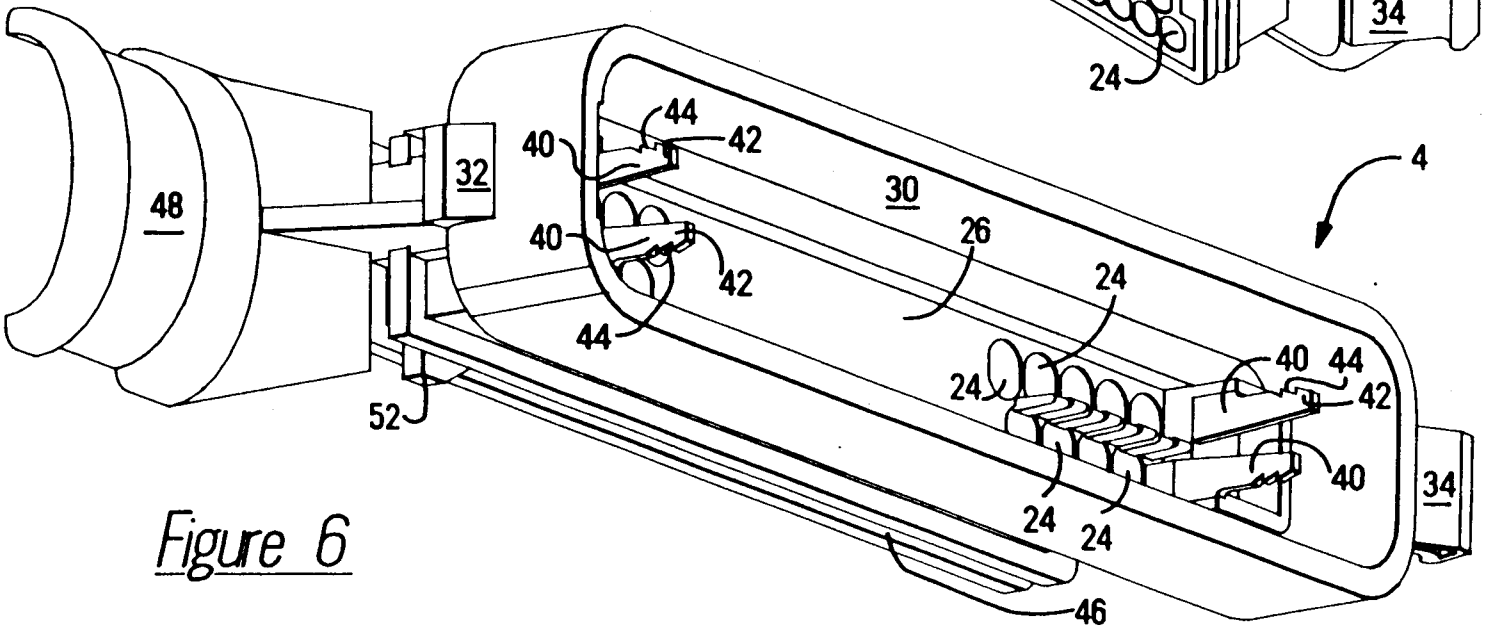
FIG. 6 is an isometric front view of the female housing.

The housing 4, as best seen in FIGS. 5 and 6, comprises an elongate block 22 of insulating material having two rows of through cavities 24 each opening into a front face 26 and a rear face 28 of the housing 4. As best seen in FIG. 9, each cavity 24, which may be of circular cross-section, is also of even cross-section. The number and arrangement of the cavities 24 is the same as that of the cavities 8, so that when the front face 12 of the housing 2 and the front face 26 of the housing 4 are positioned in alignment, each cavity 24 is aligned with a corresponding cavity 8. Projecting normally from the front face 26 is a surrounding hood 30 at the ends of which are external latch members 32 and 34, respectively, latching the hood 30 to a mating electrical connector (not shown). The hood 30 is formed with mould core access slots 36, which are shown in FIGS. 1 and 2 only. There extend from the front wall 26, a row of locking lance actuating tongues 38, which are best seen in FIG. 2, each positioned proximate to respective one of cavities 24, alternate tongues 38 being offset with respect to the adjacent tongue or tongues and each tongue extending normally of the face 26. At each end of each row of the cavities 24, is a ratchet arm 40 formed with a pair of ratchet teeth 42 and 44, respectively, the arms 40 projecting normally of the face 26, the teeth 42 and 44 of the two arms at each end of the rows of cavities 24 being directed away from one another. Proximate to the rear face 28 of the housing 4 is a peripheral groove 46 formed in the block 22 there extending from the block 22 at its left hand (as seen in FIGS. 5 and 6) end a half portion 48 of a lead exit conduit which is generally referenced 50 in FIGS. 1 and 8. In the groove 46, positioned adjacent to the conduit portion 48, are latch members 52.

Figure 4:
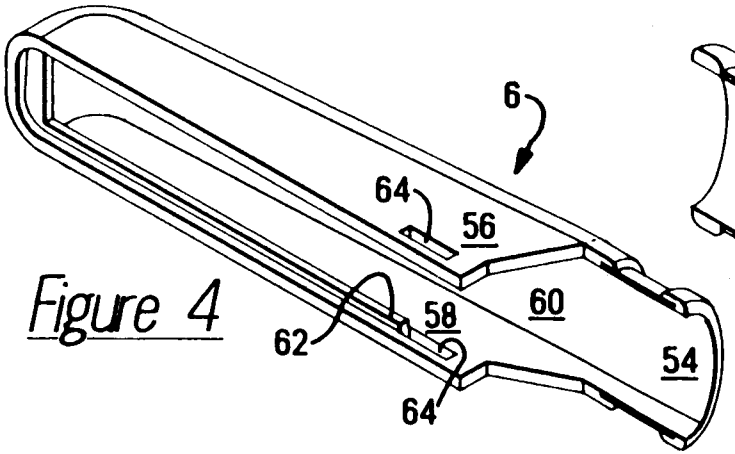
FIG. 4 is an enlarged isometric view of a cover for the female housing.

The cover 6, which is best seen in FIG. 4 is in the form of a channel shaped insulating member defining at one end, the other half portion 54 of the conduit 50 and comprising side walls 56 and 58 connected by a base 60. Proximate to its free edge each wall 56 and 58 is formed with a longitudinal rib 62 (only one of which is shown) and at the end of the rib 62 nearest to the conduit portion 54, with a latching opening 64. In order to mount the cover 6 on the housing 4, the ribs 62 are slid into the groove 46 until each latch member 52 snaps into a respective one of the latching openings 64, the conduit portions 48 and 54 cooperating to provide the exit conduit 50. The conduit portion 48 is supported by a rib 66 formed integrally with the conduit portion 48 and with the remainder of the housing 4.

Figure 7:
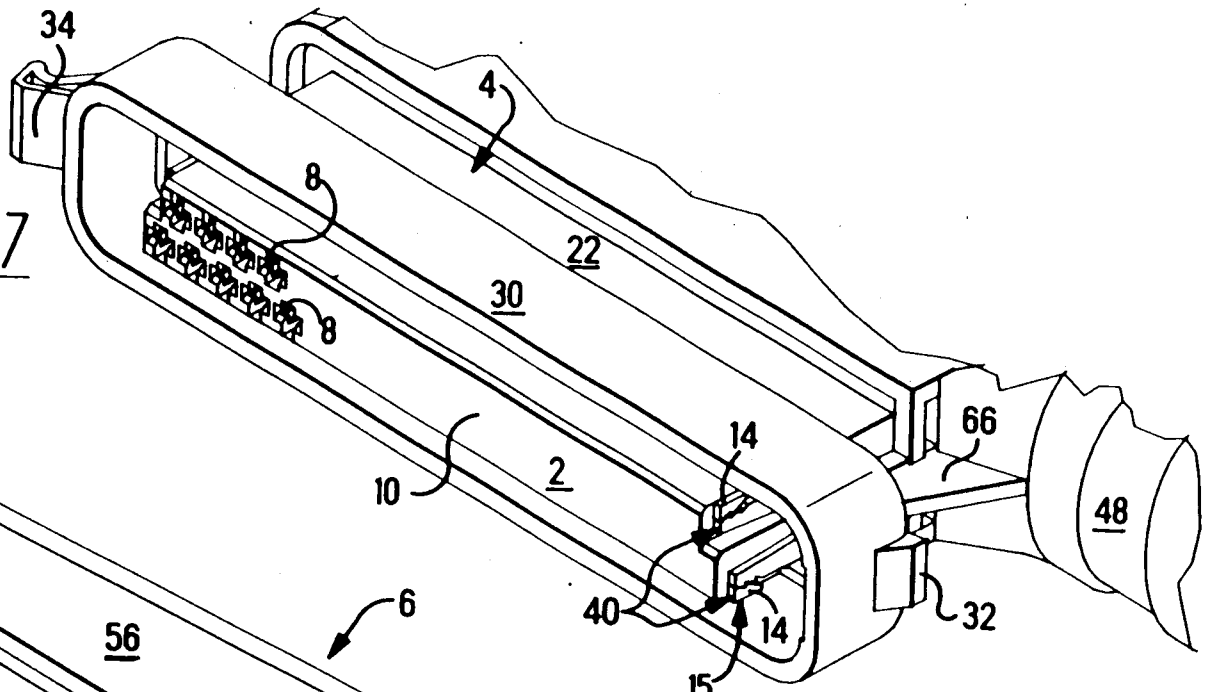
FIG. 7 is an isometric view, partly in fragmentary form, showing the male and female housings assembled in a terminal loading position.
Figure 8:
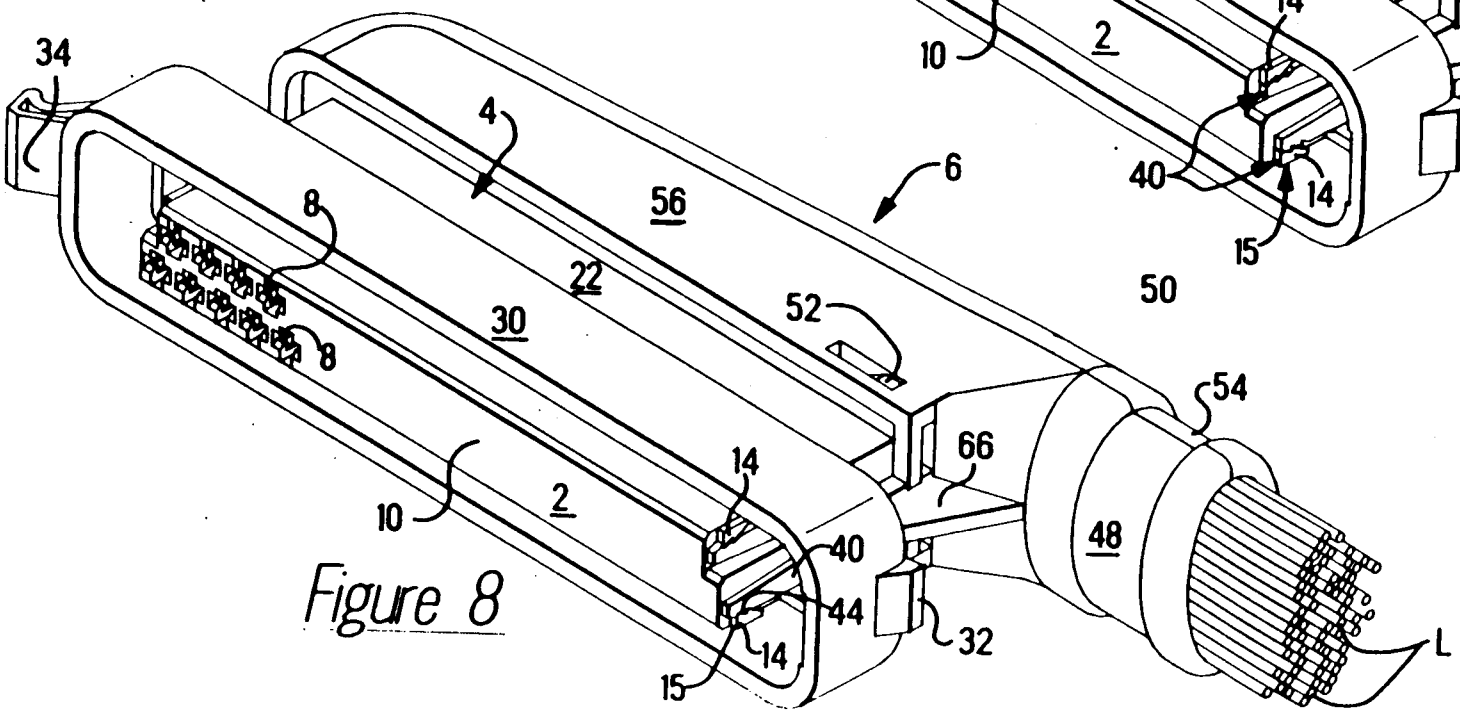
FIG. 8 is an isometric view of the housing assembly loaded with electrical terminals crimped to electrical leads and with the male and female housings in a terminal locking position.

The cavities 8 are to be loaded with electrical terminals 68 (one of which is shown in FIG. 11), each terminal 68 having a mating portion 70 in the form of a receptacle, a box shaped transition portion 72, and a crimping portion ferrule 74 which is crimped to the stripped end of the electrically conductive core C of an insulated electrical lead L and to an elastomeric sealing grommet 76 surrounding the lead L. In order to load a terminal 68 into each cavity of the housing 2, the cover 6 being dismounted from housing 4, the housing 2 is inserted into the hood 30, 50 that as shown in FIG. 7 (in which only one pair of the pawls 14 and arms 40 are shown) until each pawl 14 meshes With the endmost tooth 42 of a respective arm 40, whereby the front face 12 of the housing 2 is spaced from the front face 26 of the housing 4 as shown in FIG. 9. Housings 2 and 4 are then in a terminal loading position. With each arm 38 engaging to some extent between a respective lance 16 and adjacent wall 18 as shown in FIG. 9 and 10. In this loading position, each terminal with its lead L connected thereto as described above, is inserted, by way of the rear face 28 of the housing 4, through the corresponding cavity 24 which is aligned with a respective one of the cavities 8, with the mating portion 70 of the terminal leading, until the terminal is received in the cavity 8 with a latching lance 78 on the transition portion 72 of the terminal 68 snapped into engagement with a shoulder 80 in the cavity 8, the grommet 76 being sealing received in the cavity 24. The housing 2 is then further inserted into the hood 30 so that each pawl 14 meshes with the next following tooth 44 of the respective ratchet arm 40 so that the housings 2 and 4 are now in a terminal locking position, in which, as shown in FIG. 11, each tongue 38 is further advanced between the corresponding locking lance 16 and the adjacent wall 18, so that the shoulder 20 of the lance 16 is driven against a shoulder 82 provided by the rear end of the transition portion 72 of the terminal 68. Each terminal is accordingly positively locked in its cavity 8, against backing out therefrom by the lance 16, since the housing 2 cannot be withdrawn from its terminal locking position by virtue of the meshing of the pawls 14 with the teeth 44 of the ratchet arms 40. The leads L, which may be encased in a cable jacket (not shown) are laid in the conduit portion 48 and the cover 6 is mounted to the housing 4 in the manner described above, so that the conduit 50 is completed and extends about the leads L as shown in FIG. 8. In either the terminal loading position, or in the terminal locking position, of the housings 2 and 4, a seal 84, which may be of rectangular cross-section as shown in FIG. 11, or which may be of circular cross-section, is assembled into the hood 30.

I claim:

1. An electrical connector housing assembly comprising, a first insulating housing (2) having a plurality of terminal receiving first through cavities (8) each opening into a front and a rear face (12,10) of the housing (2) and each being provided with an internal terminal locking lance (16); a second insulating housing (4) having a plurality of terminal access second through cavities (24) each opening into a front and a rear face (26,28) of the second housing (4), where each second cavity (24) is dimensioned to receive a sealing grommet (84) surrounding an electrical lead connected to the respective terminal (68); a terminal locking lance actuating member (38) projecting from the front face (26) of the second housing (4) proximate to each of the second cavities (24); and means (15,40) on the housings (2,4) for latching them together in a terminal loading position with the front faces (12,26) of the housings (2,4) spaced from each other and each first cavity (8) in alignment with a respective second cavity (24) to allow an electrical terminal (68) to be inserted into each first cavity (8) by way of the second cavity (24) aligned therewith, from the rear face (28) of the second housing (4), the latching means (15,40) permitting the housings (2,4) to be moved relatively towards each other from said loading position, so as to be latched in a terminal locking position in which the terminal locking lance actuating members (38) penetrate the first cavities (8) to actuate the internal terminal locking lances (16) therein positively to retain the terminals (68) in the first cavities (8).

2. An assembly as claimed in claim 1, wherein said latching means (15,40) comprise cooperating pairs of latch arms (15,40) on the housings (2,4), one arm of each pair having a ratchet (42,44) extending normally from the front face (26) of the housing (4) on which the arm (40) is provided, and the other latch arm (15) of the pair having a pawl (14) for meshing with a first tooth (42) of the ratchet (42,44), in said terminal loading position and with a second tooth (44) of the ratchet (42,44) in said terminal locking position.

3. An assembly as claimed in claim 2, wherein the one latch arm (40) of each pair extends from the front face (26) of the second housing (4) into a hood (30) projecting from that front face (26), for receiving the first housing (2).

4. An assembly as claimed in claim 1, wherein each locking lance (16) extends from a wall (26) of its respective cavity (8) obliquely towards the front face (12) of the first housing (2), each locking lance actuating member (38) being in the form of a tongue which engages between the respective locking lance (16) and the wall (26) from which it extends, to a lesser extent in the loading position of the housings (2,4) and to a greater extent the terminal locking position thereof to force the locking lance (16) against a terminal (68) in the first cavity (8).

5. An assembly as claimed in claim 4, wherein the locking lance (16) has a shoulder (20) for engagement with a shoulder (82) of the terminal (68), in the locking position of the housings.

6. An electrical connector housing assembly comprising, a first insulative housing (2) having a plurality of terminal receiving first through cavities (8) each opening into a front and a rear face (12,10) of the housing (2) and each being provided with an internal terminal locking lance (16); a second insulating housing (4) having a plurality of terminal access second through cavities (24) each opening into a front and a rear face (26,28) of the second housing (4), where said second housing (4) is formed integrally with a part of a lead exit conduit (50) projecting from one end of said rear face (28), and the assembly further comprises a cover (6) for said rear face (28), the cover (6) being latchable to the second housing (4) to complete the cable conduit;

a terminal locking lance actuating member (38) projecting from the front face (26) of the second housing (4) proximate to each of the second cavities (24); and means (15,40) on the housings (2,4) for latching them together in a terminal loading position with the front faces (12,26) of the housings (2,4) spaced from each other and each first cavity (8) in alignment with a respective second cavity (24) to allow an electrical terminal (68) to be inserted into each first cavity (8) by way of the second cavity (24) aligned therewith, from the rear face (28) of the second housing (4), the latching means (15,40) permitting the housings (2,4) to be moved relatively towards each other from said loading position, so as to be latched in a terminal locking position in which the terminal locking lance actuating members (38) penetrate the first cavities (8) to actuate the internal terminal locking lances (16) therein positively to retain the terminals (68) in the first cavities (8).

* * * * *